US011247759B2

(12) United States Patent
Miller

(10) Patent No.: US 11,247,759 B2
(45) Date of Patent: Feb. 15, 2022

(54) SPONSON ATTACHMENT FOR AIRBOAT

(71) Applicant: Billy Miller, Embudo, NM (US)

(72) Inventor: Billy Miller, Embudo, NM (US)

(73) Assignee: Billy Miller, Embudo, NM (US)

( * ) Notice: Subject to any disclaimer, the term of this patent is extended or adjusted under 35 U.S.C. 154(b) by 27 days.

(21) Appl. No.: 16/923,697

(22) Filed: Jul. 8, 2020

(65) Prior Publication Data

US 2021/0024188 A1 Jan. 28, 2021

Related U.S. Application Data

(62) Division of application No. 15/345,069, filed on Nov. 7, 2016, now abandoned.

(60) Provisional application No. 62/252,106, filed on Nov. 6, 2015.

(51) Int. Cl.

| | |
|---|---|
| ***B63H 7/02*** | (2006.01) |
| ***B63B 59/02*** | (2006.01) |
| ***B63B 43/14*** | (2006.01) |
| ***B63B 7/08*** | (2020.01) |

(52) U.S. Cl.

CPC ..... *B63H 7/02* (2013.01); *B63B 7/082* (2013.01); *B63B 43/14* (2013.01); *B63B 59/02* (2013.01); *B63B 2043/145* (2013.01); *B63B 2059/025* (2013.01)

(58) Field of Classification Search

CPC .... B63H 7/00; B63H 7/02; B63B 7/08; B63B 7/082; B63B 43/14; B63B 2043/145; B63B 59/02; B63B 2059/025

See application file for complete search history.

(56) References Cited

U.S. PATENT DOCUMENTS

| | | | | |
|---|---|---|---|---|
| 4,724,785 | A | 2/1988 | Van Hauwaert | |
| 4,807,556 | A | 2/1989 | Hillier | |
| 4,942,838 | A * | 7/1990 | Boyer | B63H 11/04 114/345 |
| 5,112,257 | A | 5/1992 | Grise | |
| 6,810,827 | B2 * | 11/2004 | Hansen | B63B 7/082 114/345 |
| 6,877,455 | B2 | 4/2005 | Hong | |
| 7,090,549 | B2 | 8/2006 | Garcia | |
| 7,748,339 | B2 | 7/2010 | Oh | |
| 8,167,668 | B2 | 5/2012 | Robicheaux | |
| 8,939,805 | B2 | 1/2015 | Miller | |
| 2006/0073745 | A1 | 4/2006 | Ficht et al. | |
| 2007/0134999 | A1 | 6/2007 | Ficht et al. | |
| 2017/0174291 | A1 * | 6/2017 | Miller | B63B 43/14 |

FOREIGN PATENT DOCUMENTS

| | | | |
|---|---|---|---|
| EP | 0193874 | A1 | 9/1986 |
| EP | 0583226 | B1 | 12/1996 |
| FR | 23235573 | A1 | 4/1977 |
| GB | 2174958 | A | 11/1986 |

* cited by examiner

*Primary Examiner* — Ajay Vasudeva
(74) *Attorney, Agent, or Firm* — Merchant & Gould P.C.

(57) ABSTRACT

A sponson attachment for an airboat allows the airboat to increase its safety and stability very quickly. A method for attaching a sponson to an airboat hull includes attaching first and second flexible tethers to a side of the sponson. The method also includes removably securing the first flexible tether to an exterior of the airboat hull adjacent a gunnel, and removably securing the second flexible tether below the first flexible tether on the exterior of the hull.

5 Claims, 8 Drawing Sheets

SPONSON ATTACHMENT FOR AIRBOAT

CROSS-REFERENCE TO RELATED APPLICATIONS

The present application is a divisional of U.S. application Ser. No. 15/345,069, filed on Nov. 7, 2016, now abandoned; which claims priority from U.S. Provisional Application No. 62/252,106, filed on Nov. 6, 2015, the disclosure of which is hereby incorporated by reference in its entirety.

BACKGROUND

Air-propelled watercrafts, or airboats, use air-propulsion to propel flat-bottom hulled boats through waterways. Traditionally, the boats include a rear mounted propeller that extends above the hull of the boat. Such watercrafts are relatively compact, allowing them to maneuver through brush, reeds, or other low-water conditions. However, these airboats have drawbacks. For example, in the case of open water conditions, and in particular in windy conditions where currents or waves may be significant, traditional airboats become unstable and could capsize. This is partly due to the fact that airboats tend to utilize hulls with low sides and have comparatively tall propeller assemblies, making the boats top heavy. Additionally, there exist other conditions in which it is unsafe to operate an airboat, such as in inclement weather conditions.

For these and other reasons, improvements are desired.

SUMMARY

The present disclosure relates generally to a sponson attachment for an airboat hull to improve the safety and stability of the airboat. In one possible configuration, and by non-limiting example, the sponsons are inflatable and removably attached at the sides of an airboat hull.

In a first aspect of the present disclosure, a method for attaching a sponson to an airboat hull is disclosed. The method includes attaching a first and second flexible tether to a side of the sponson. The method also includes removably securing the first flexible tether to an exterior of the airboat hull adjacent a gunnel. The method also includes removably securing the second flexible tether below the first flexible tether on the exterior of the hull.

In a second aspect of the present disclosure, an airboat hull sponson retrofit kit is disclosed. The kit includes an inflatable sponson that has a first and second tether attached to a side thereof. Each tether has an attachment cylinder secured to an end. The kit also includes a first tether attachment for attaching to an airboat hull. The first tether attachment includes a channel that is configured to receive the attachment cylinder of the first tether. The kit also includes a second tether attachment for attaching to the airboat hull, and the second tether attachment also includes a channel configured to receive the attachment cylinder of the second tether.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
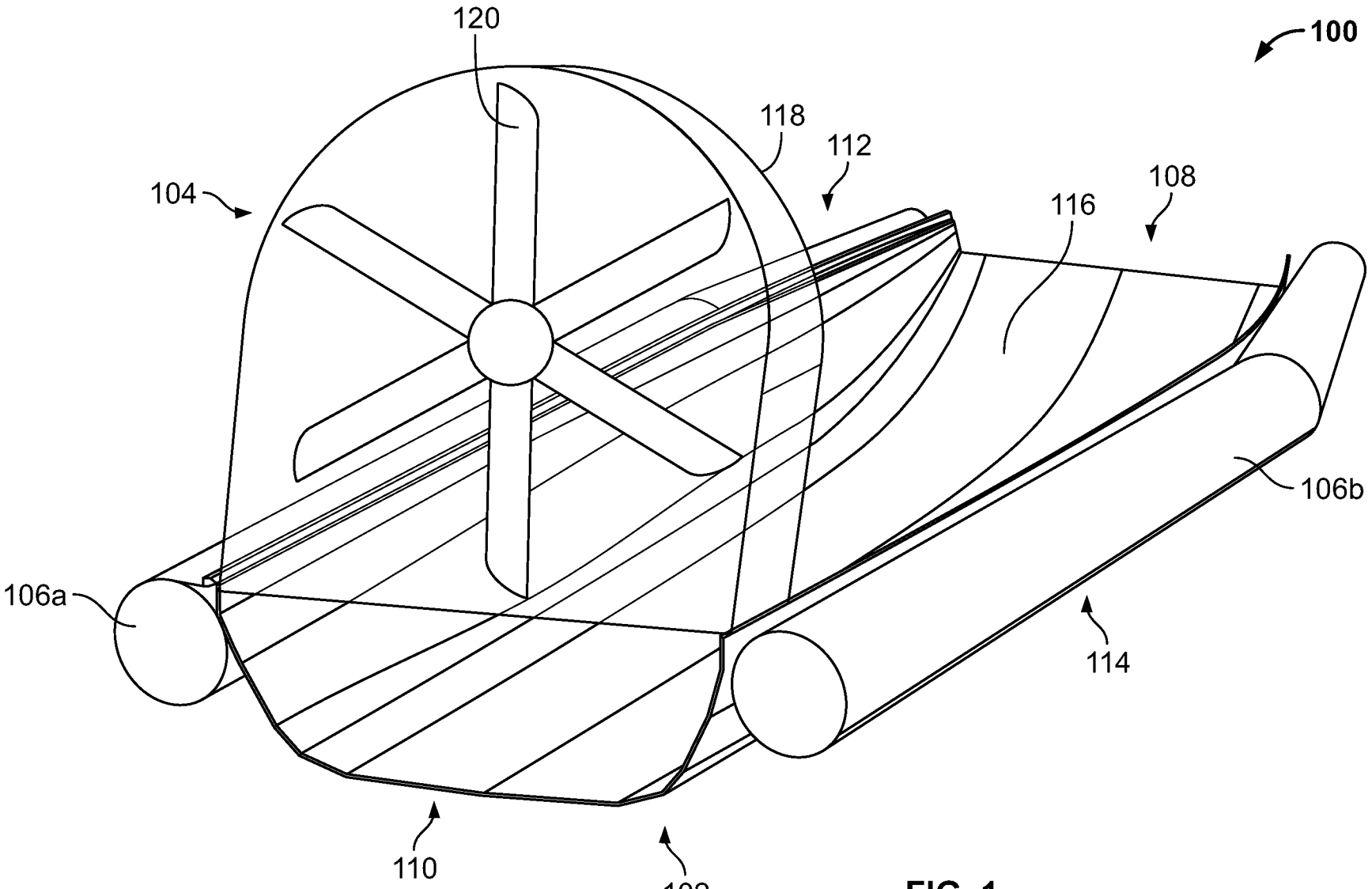
FIG. 1 illustrates a perspective view of an airboat according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The removably attachable sponson kit disclosed herein has several advantages. The kit allows an existing airboat to be retrofitted to include a pair of floatable sponsons secured to the hull of the airboat. The sponsons provide the airboat with additional buoyancy, which increases the safety of the airboat. Additionally, the sponsons provide the airboat with additional stability, allowing the airboat to safely traverse deeper and rougher water while decreasing the likelihood of the boat capsizing and/or submerging if capsized.

An airboat 100 is shown in FIG. 1. The airboat 100 includes a hull 102, a propeller assembly 104, and a pair of removable sponsons 106*a*, 106*b*. The airboat 100 is configured to transport cargo and people across a variety of different waterways under a variety of different conditions.

The hull 102 can be configured in a variety of ways to haul a variety of different cargo loads. In some embodiments, the hull can include a rider deck with a plurality of seats. In other embodiments, the hull can be configured to haul cargo. In the depicted embodiments, the hull is a flat-bottomed hull. Further, the hull 102 is constructed of metal or other hard, resilient material. In some embodiments, the hull 102 is constructed of aluminum. The hull 102 includes a front 108, a rear 110, a left side 112, and a right side 114. As shown, the front 108 of the hull 102 includes an upward sloping bottom 116. At the rear 110 of the hull 102, the propeller assembly 104 is attached. At both the left and right sides 112, 114, removable sponsons 106 are mounted to the hull 102.

The propeller assembly 104 is shown schematically in FIG. 1. The propeller assembly 104 includes a support structure 118 for housing a propeller 120. The propeller 120 is powered by a motor (not shown). The propeller 120, when driven by the motor, propels the airboat 100 through the water. More specifically, the propeller 120 generates a rearward column of air that propels the airboat 100 in a forward direction. A rudder (not shown) can be included, as is known in the art, to steer the airboat 100 in an operator-selectable direction.

In the embodiment shown, the airboat 100 includes the first sponson 106*a* and the second sponson 106*b* attached at the sides 112, 114 of the hull 102. Specifically, the first and second sponsons 106*a*, 106*b* are inflatable and removably attached to the hull 102. The sponsons 106*a*, 106*b* provide stability and flotation to the airboat 100 and enable the transport of loads or personnel. In some alternative embodiments, the sponsons may be rigid. In the depicted embodiment, the sponsons 106*a*, 106*b* follow the shape of the sides 112, 114 of the hull and are at least partially curved near the front 108 of the hull. For example, the sponsons can be substantially cylindrical, and be tapered at a front end (bow end) and/or a back end (stern end). In the example shown, the sponsons 106*a*, 106*b* are tapered at a front end, e.g., toward a bow of the airboat hull. Additionally, the sponsons can be of complementary shapes to be located along the hull, e.g., being mirror images of one another.

Other sponson shapes are also possible to accommodate a variety of differently shaped hulls. For example, the sponsons could be formed from a unitary tube, and form a U-shaped outer hull surrounding a front and both sides 112, 114 of the airboat 100. In such an arrangement a portion of the sponsons 106*a*-106*b* that spans across the front of the airboat may be raised relative to the side portions to reduce any possible drag caused by that portion. In example embodiments, the sponsons 106*a*, 106*b* can, when mounted to the hull, be located at a height above a water line of the airboat hull when the airboat is loaded to a predetermined degree (e.g., based on an average load, or based on a maximum load), thereby reducing drag caused by the sponsons 106*a*, 106*b* during normal operation of the airboat 100.

The sponsons 106*a*, 106*b* are preferably scratch and abrasion resistant, and thus, may endure for long periods in rough water environments, including swift water, white water, open sea, ice, snow, and shallow water mixed with rocks and/or vegetation. For example, the airboat 100 is designed to travel in high waves and/or shallow water. The sponsons 106*a*, 106*b* may also be unaffected by gas, oil, and diesel that may seep from the motor or from other external or internal sources. Due to their inflatable characteristics, the sponsons 106*a*, 106*b* act as bumpers and fenders and rebound off of objects (i.e., rocks, ice, other watercrafts, or the like) that may exist in the trajectory of the airboat 100 to which they are attached. In some embodiments, the sponsons 106*a*, 106*b* are made from polyurethane and are bullet-proof to 9 mm ammunition. In other embodiments, the sponsons 106*a*, 106*b* may be made from alternate materials and may be bullet-proof to varying degrees.

The sponsons 106*a*, 106*b* may also be equipped with one or more baffles, or separable chambers, within the sponsons 106*a*, 106*b*. The baffles promote floatation and prevent or mitigate the effects of vibrations, which are increased in rough water conditions. In other words, the baffles promote stability of the sponsons 106*a*, 106*b*, and ensure that a single puncture of a sponson would not immediately compromise flotation.

Figure 2:
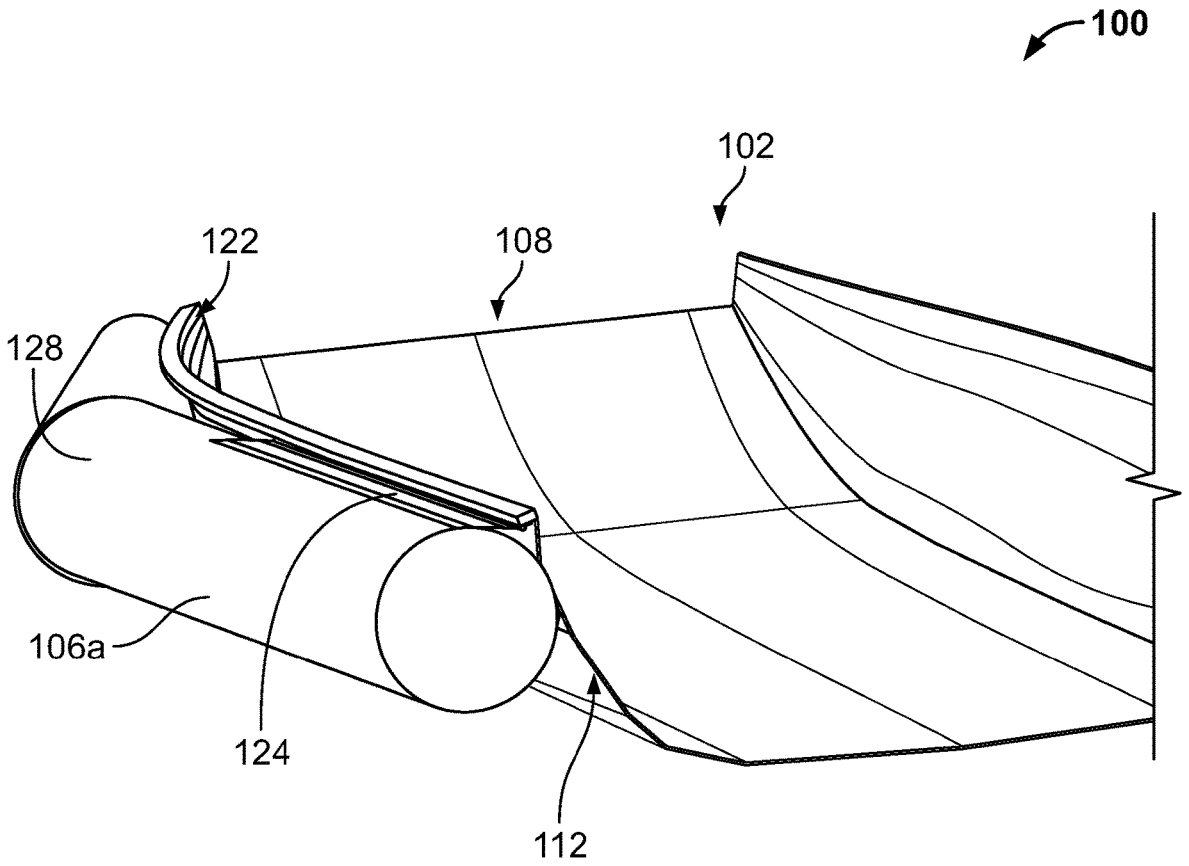
FIG. 2 illustrates a perspective side view of the airboat of FIG. 1.

FIG. 2 shows an isometric view of a portion of the airboat 100, specifically the left side 112 of the hull 102 and the attached sponson 106*a*. Positioning of the sponson 106*b* at the right side 114 of the hull 102 is substantially similar to the positioning of the sponson 106*a*, and therefore not shown. As shown, the sponson 106*a* is attached to the hull 102 adjacent a gunnel 122 of the hull 102. By attaching the sponson 106*a* next to the gunnel 122 of the hull 102, less of the sponson is likely to drag in the water during operation of the airboat 100. This allows the airboat to operate with less drag in the water, allowing it to travel at high speeds and be more maneuverable. However, because the sponson 106*a* is mounted on the side 112 of the hull, the sponson 106*a* still provides support and stability to the airboat 100 during times when it becomes unstable. Additionally, the sponson 106*a* provides a barrier for crashing waves so as to help prevent water from entering the interior of the airboat 100.

Figure 3:
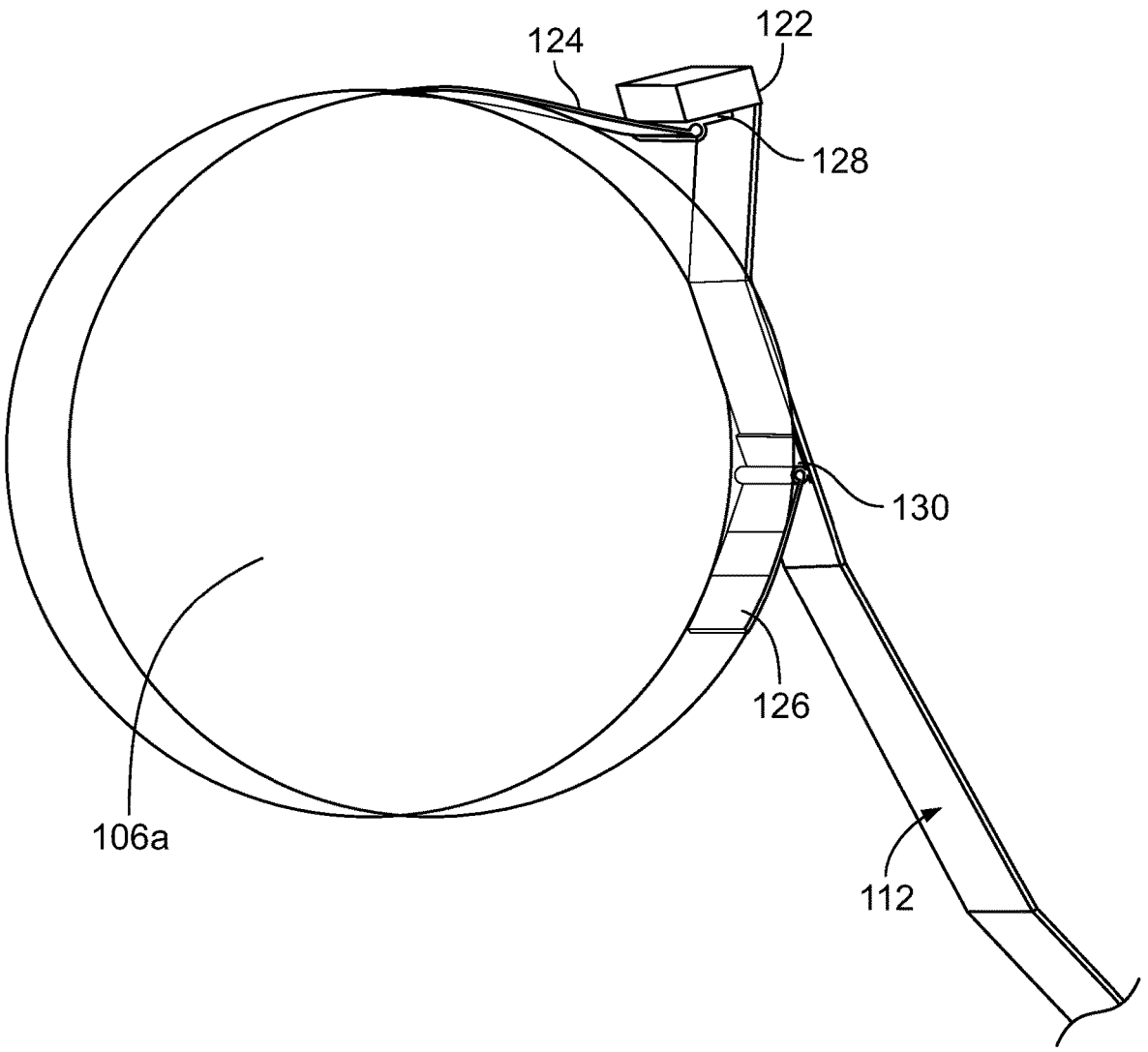
FIG. 3 illustrates a schematic side view of a sponson attached to a side of the airboat of FIG. 1.
Figure 4:
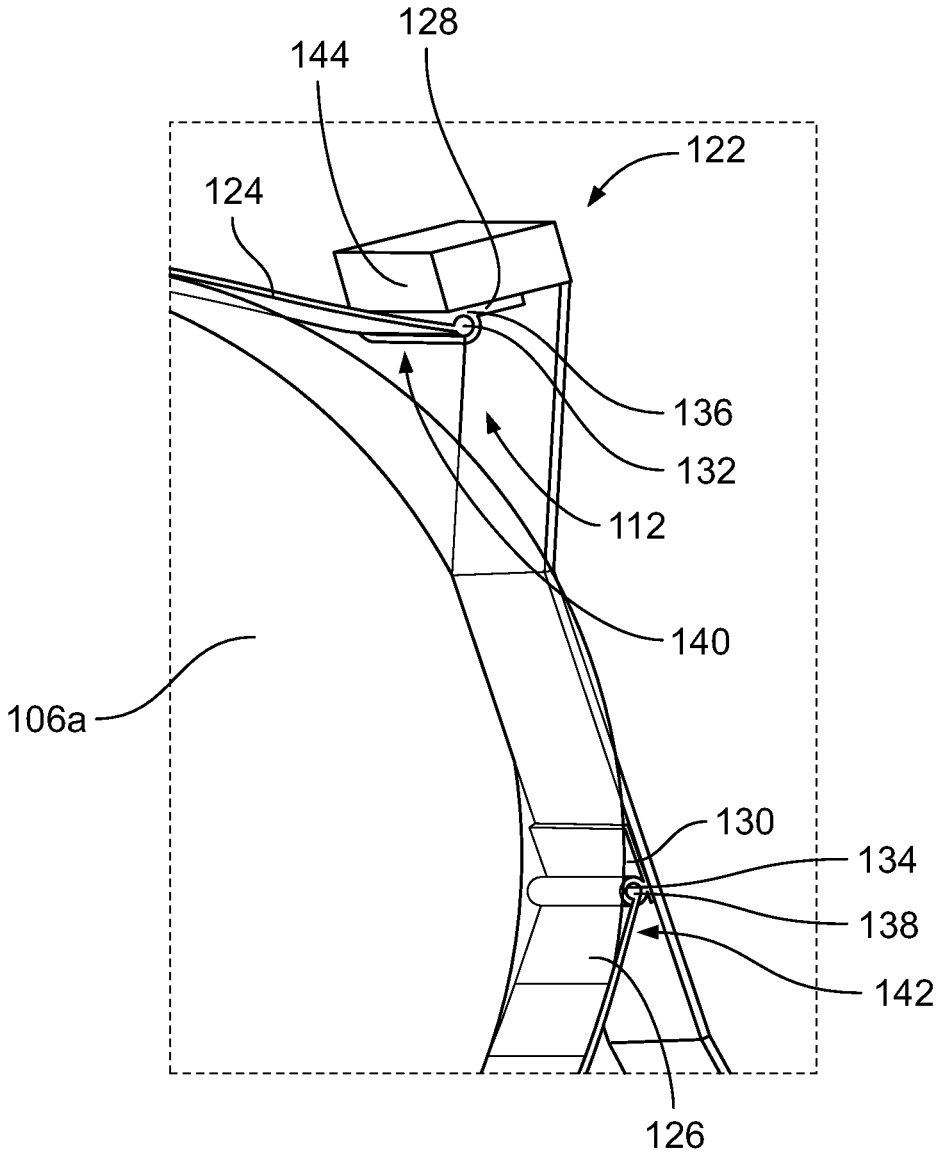
FIG. 4 illustrates a schematic side view of a sponson and corresponding attachment mechanisms attached to a side of the airboat of FIG. 1.

FIGS. 3-4 show schematic views of the attachment used to removably attach the sponsons 106*a*, 106*b* to the hull 102. Again, only the left side 112 is shown; however, positioning and attachment of the sponson 106*b* at the right side 114 of the hull 102 is substantially similar. As shown, the sponson 106*a* includes a first tether 124, and a second tether 126 each attached at a side 128 (shown in FIG. 2) of the sponson 106*a*. The tethers 124, 126 are then attached to upper and lower attachment mechanisms 128, 130 respectfully. The upper and lower attachment mechanisms 128, 130 are secured to hull 102 and are configured to hold the sponson 106*a* securely against the side 112 of the hull 102. As shown, each upper and lower attachment mechanism 128, 130 includes a channel 132, 134.

The first and second tethers 124, 126 are secured to the side 128 of the sponson 106*a* and are flexible. In some embodiments, the tethers are adhered to the sponson. In still other embodiments, they are stitched to the sponson 106*a*. In other embodiments, the tethers are manufactured from the same material as the sponsons 106*a*, 106*b*. Further, the tethers 124, 126 each include interfacing portions 136, 138 at ends 140, 142. In the depicted embodiment, the interfacing portion 136, 138 are cylinders that are configured to slide within the channels 132, 134 of the upper and lower attachment mechanisms 128, 130. The interfacing portions 136, 138 can be sized and shaped in variety of different ways so long as they match the size and shape of the channels 132 and 134.

The upper and lower attachment mechanisms 128, 130 can be constructed of metal or other resilient material. The upper attachment mechanism 128 is secured adjacent the gunnel 122 of the side 112. In the depicted embodiment, the upper attachment mechanism 128 is secured under a lip 144 of the gunnel 122. In some embodiments, the lip 144 can be secured to the hull 102 during the fitting of the sponson 106*a*. The lower attachment mechanism 130 is also secured at the exterior of side 112.

In one embodiment, the sponsons 106*a*, 106*b* and their respective tethers 124, 126, along with upper and lower attachment mechanisms 128, 130 for each side 112, 114 can be distributed as a retro-fit kit for airboats. This allows a user to removably attach the sponsons 106*a*, 106*b* to the airboat 100 when desired, allowing the user freedom to customize their particular airboat for specific applications.

Figure 5:
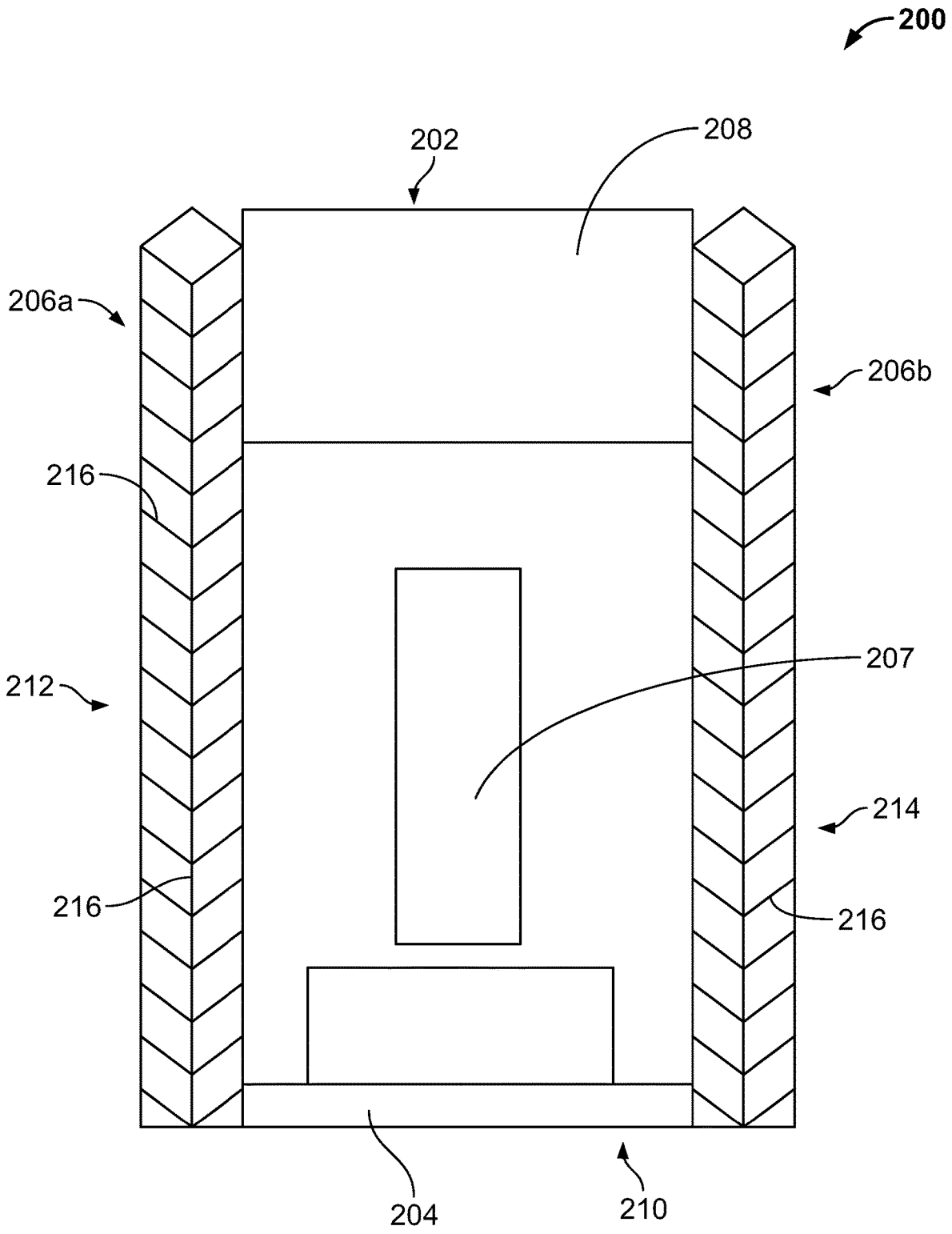
FIG. 5 illustrates a top view of an airboat according to one embodiment of the present disclosure.

FIGS. 5-8 depict an airboat according to another embodiment of the present disclosure. FIG. 5 shows a schematic top view of an airboat 200. The airboat 200 includes a main hull 202, a propeller assembly 204, and a pair of sponsons holders 206*a*, 206*b*. Like the airboat 100 described above, the airboat 200 is configured to transport cargo and people across a variety of different waterways under a variety of different conditions. Additionally, the airboat 200 can be used as a rescue boat and provides the user improved stability and safety over traditional airboats.

The interior of main hull 202 can be configured in a variety of ways to haul a variety of different cargo loads. As depicted, the main hull 202 includes a bench 207 that is positioned longitudinally with respect to the main hull 202. In some embodiments, the main hull 202 can include a rider deck with a plurality of seats. In other embodiments, the main hull 202 can be configured to haul cargo. In the depicted embodiments, the main hull 202 is a flat-bottomed hull and is constructed of metal or other hard, resilient material. In some embodiments, the main hull 202 is constructed of aluminum. Like the hull 102 described above, the main hull 202 includes a front 208, a rear 210, a left side 212, and a right side 214. As shown, the front 208 of the main hull 202 includes an upward sloping bottom. At the rear 210 of the main hull 202, the propeller assembly 204 is attached. At both the left and right sides 212, 214, the sponson holders 206*a*, 206*b* are attached to the main hull 202. In some embodiments, the sponson holders 206*a*, 206*b* may be rigidly attached the main hull 202. In other embodiments, the sponson holders 206*a*, 206*b* may be integral with the main hull 202.

The sponson holders 206*a*, 206*b* are configured to hold inflatable sponsons (shown in FIGS. 6-8) so as to provide additional floatation and stability to the airboat 200. The sponson holders 206*a*, 206*b* can hold sponsons similar to the sponsons 106*a*, 106*b* described above. In some embodiments, sponsons may be permanently attached to the sponson holders 206*a*, 206*b*. In other embodiments, sponsons may be removably attached to the sponson holders 206*a*, 206*b*, for example using the tethers as described above in connection with FIGS. 1-4. As shown, the sponson holders 206*a*, 206*b* are attached at the sides of the main hull 202 and are constructed as cages. The sponson holders 206*a*, 206*b* are rounded and rigid so as to accept the inflatable sponsons. In some embodiments, the sponson holders 206*a*, 206*b* are constructed of metal or similarly rigid material. As shown, the sponson holders include a plurality of rails 216 to contain the sponsons within the sponson holders 206*a*, 206*b*.

Figure 6:
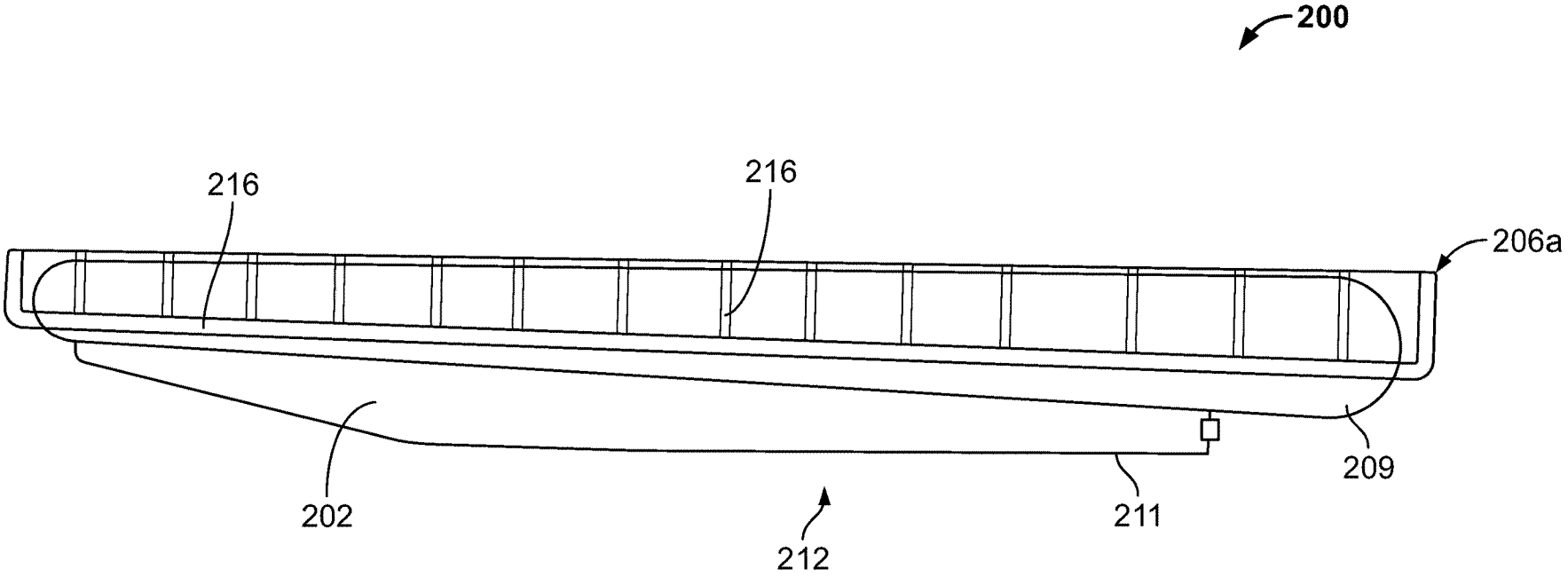
FIG. 6 illustrates a perspective side view of the airboat of FIG. 5.

FIG. 6 shows a left side view of a portion of the airboat 200. As shown, the sponson holder 206*a* surrounds a sponson 209 so as to mount the sponson 209 to the main hull 202. Additionally, the sponson holder 206*a* is positioned so as to position the sponson 209 above a bottom 211 of the main hull 202. This allows the main hull 202 to ride in the water while the sponson 209 floats on top of the water, which creates less drag for the airboat 200. The right side 214 of the airboat 200 is substantially similar to the left side 212, and therefore not shown.

Figure 7:
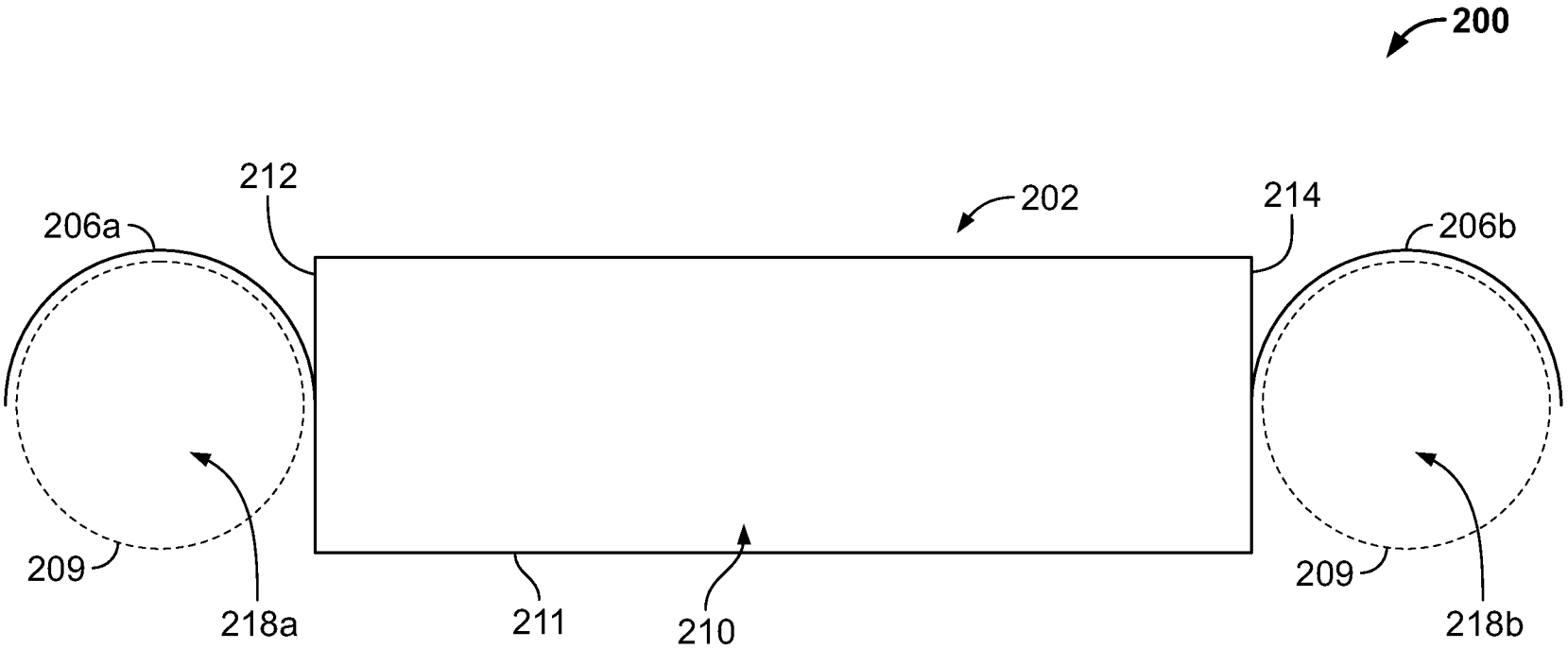
FIG. 7 illustrates a schematic rear view of the airboat of FIG. 5.

FIG. 7 shows a back schematic view of the airboat 200. As shown, the sponson holders 206*a*, 206*b* have a half moon cross-section. This shape allows the sponson holders 206*a*, 206*b* to provide rigidity to the sponsons that are secured inside the holders 206*a*, 206*b*. As shown, the sponson holders 206*a*, 206*b* each have an open side 218*a*, 218*b* that faces the bottom 211 of the main hull 202, e.g., is convex in shape.

Figure 8:
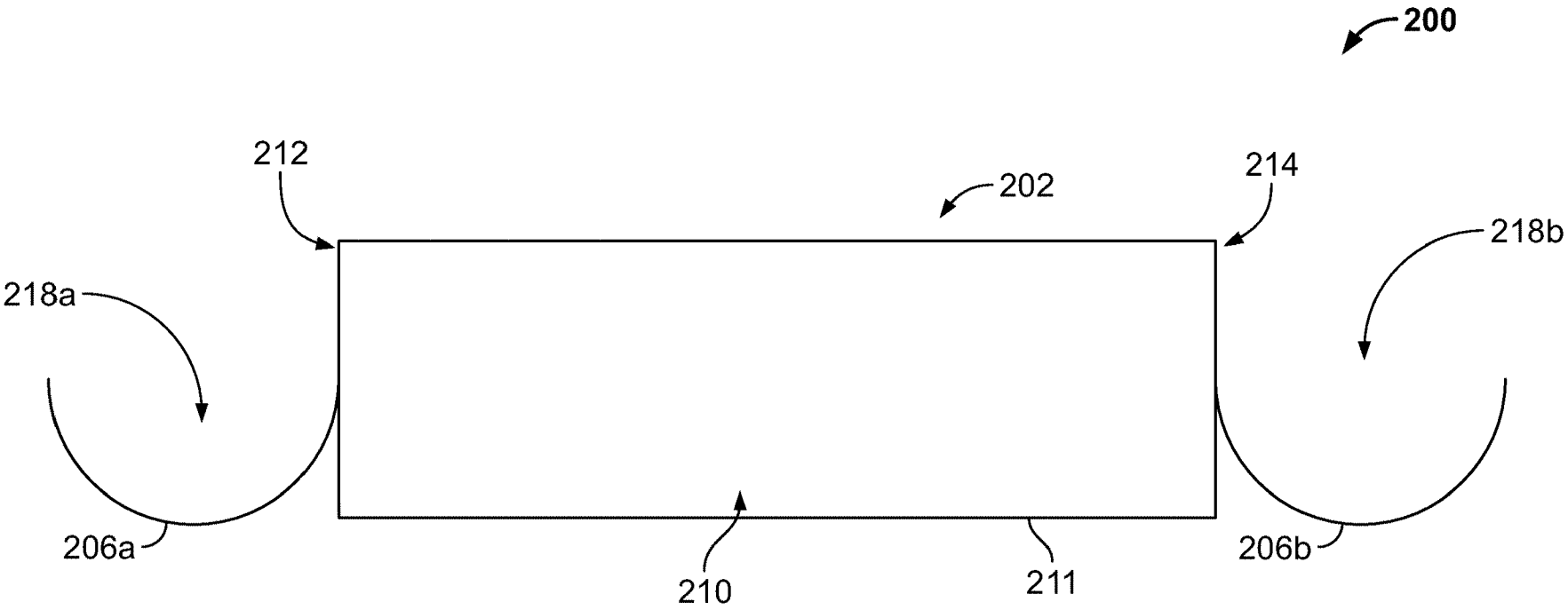
FIG. 8 illustrates a schematic rear view of the airboat of FIG. 5 with sponson holders in an alternative arrangement.

FIG. 8 shows an alternative arrangement for the sponson holders 206*a*, 206*b* on the airboat. In the depicted embodiment, the open sides 218*a*, 218*b* of the sponson holders 206*a*, 206*b* face away from the bottom 211 of the main hull 202. Such positioning allows the sponsons 209 to sit and be secured in the sponson holders 206*a*, 206*b*, e.g., being concave in shape.

Referring to FIGS. 1-8 generally, it is recognized that the watercraft disclosed herein have a number of advantages over existing airboats or other watercraft. In particular, the improvements disclosed herein allow for increased safety for airboats, especially when using such airboats as rescue boats. The sponsons allow for improved maneuverability, while also allowing for improved buoyancy and handling in open water and adverse weather conditions.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. An airboat comprising:

a fan propeller for generating a propelling column of air;

a motor coupled to the fan propeller;

a flat-bottom hull, the hull having a forward bow and a rearward stern, wherein the bottom of the hull is upward sloping adjacent the bow, the fan propeller and motor being mounted to the hull, wherein the motor powers the fan propeller, and the fan propeller propels the hull in a forward direction;

first and second inflatable sponsons secured above a waterline of the hull, the first and second inflatable sponsons each having a tapered end oriented to be attached toward the bow of the hull, each sponson being contoured to fit along opposite gunnels of the hull, respectively, the inflatable sponsons each having a plurality of flexible tethers attached to a side thereof, the plurality of flexible tethers each having a flexible length and each being adjustably mountable to the sponsons, each flexible tether having an attachment member secured to an end thereof; and a plurality of sponson attachments secured to the hull, each sponson attachment including a channel, wherein each sponson attachment is configured to receive a respective attachment member of a respective flexible tether, wherein the plurality of sponson attachments includes upper and lower sponson mechanisms related to each of the first and second inflatable sponsons, wherein each upper attachment mechanism is secured immediately adjacent the gunnels of the hull and each lower attachment mechanism is positioned on the hull above a lowest portion of the respective first and second inflatable sponsons.

2. The airboat of claim 1, wherein each sponson is selectively removable from the hull.

3. The airboat of claim 1, wherein each of the plurality of flexible tethers are selectively wrappable around a side of the sponson to allow for adjustable mounting of the sponson against the hull.

4. The airboat of claim 1, wherein the attachment members of each flexible tether is cylindrical.

5. The airboat of claim 1, wherein the channels of each sponson attachment are protruding from the hull.

* * * * *